US012729618B2

(12) United States Patent
Katterbauer et al.

(10) Patent No.: US 12,729,618 B2
(45) Date of Patent: Sep. 8, 2026

(54) METHODS AND SYSTEMS FOR PREDICTING CONDITIONS AHEAD OF A DRILL BIT

(71) Applicant: SAUDI ARABIAN OIL COMPANY, Dhahran (SA)

(72) Inventors: Klemens Katterbauer, Dhahran (SA); Abdallah A. Alshehri, Dhahran (SA); Alberto Marsala, Venice (IT); Ali Abdallah Alyousef, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 892 days.

(21) Appl. No.: 18/162,599

(22) Filed: Jan. 31, 2023

(65) Prior Publication Data

US 2024/0254874 A1 Aug. 1, 2024

(51) Int. Cl.

| | |
|---|---|
| ***E21B 44/00*** | (2006.01) |
| ***E21B 7/04*** | (2006.01) |
| ***E21B 47/02*** | (2006.01) |

(52) U.S. Cl.

CPC ..... *E21B 44/00* (2013.01); *E21B 7/04* (2013.01); *E21B 47/02* (2013.01); *E21B 2200/22* (2020.05)

(58) Field of Classification Search

CPC . E21B 44/00; E21B 7/04; E21B 47/02; E21B 2200/22

See application file for complete search history.

(56) References Cited

U.S. PATENT DOCUMENTS

| | | | | |
|---|---|---|---|---|
| 2012/0298420 | A1 | 11/2012 | Seydoux et al. | |
| 2015/0300151 | A1 | 10/2015 | Mohaghegh | |
| 2017/0306701 | A1 | 10/2017 | Wu et al. | |
| 2018/0223656 | A1 | 8/2018 | Yang et al. | |
| 2019/0265381 | A1 | 8/2019 | Sugiura et al. | |
| 2019/0353813 | A1 | 11/2019 | Cobos et al. | |
| 2020/0233113 | A1 | 7/2020 | Luo et al. | |
| 2020/0340350 | A1 | 10/2020 | Denisenko et al. | |
| 2021/0089897 | A1 | 3/2021 | Zhang et al. | |
| 2021/0148213 | A1 | 5/2021 | Madasu et al. | |
| 2021/0233008 | A1 | 7/2021 | Gupta et al. | |
| 2021/0247534 | A1 | 8/2021 | Bø | |
| 2021/0388714 | A1* | 12/2021 | Katterbauer | E21B 47/04 |
| 2022/0003108 | A1* | 1/2022 | Parak | E21B 44/00 |
| 2022/0090481 | A1 | 3/2022 | Aljedaani et al. | |

(Continued)

FOREIGN PATENT DOCUMENTS

| | | | |
|---|---|---|---|
| CN | 112230278 | A | 1/2021 |
| CN | 113642816 | A | 11/2021 |

(Continued)

OTHER PUBLICATIONS

Office Action issued in corresponding Saudi Arabian Patent Application No. 1020241453, mailed Feb. 24, 2026 (6 pages).

(Continued)

*Primary Examiner* — Kyle J Kingsland

(74) *Attorney, Agent, or Firm* — Osha Bergman Watanabe & Burton LLP

(57) ABSTRACT

A method for predicting conditions ahead of a drill bit while drilling a well involves performing, using a machine learning model, a classification of formation properties ahead of the drill bit, based on data that includes logging-while-drilling (LWD) data obtained while drilling the well.

14 Claims, 4 Drawing Sheets

(56) References Cited

U.S. PATENT DOCUMENTS

| | | | | |
|---|---|---|---|---|
| 2022/0114302 | A1 | 4/2022 | Skripkin | |
| 2022/0156595 | A1* | 5/2022 | Kadayam Viswanathan | G06N 3/09 |
| 2022/0187489 | A1* | 6/2022 | Yang | E21B 44/00 |
| 2022/0187493 | A1 | 6/2022 | Smith et al. | |
| 2023/0140656 | A1 | 5/2023 | Hegge et al. | |
| 2023/0333274 | A1 | 10/2023 | Tian et al. | |
| 2024/0036228 | A1* | 2/2024 | Combs | E21B 7/04 |
| 2024/0077641 | A1 | 3/2024 | Haceb | |

FOREIGN PATENT DOCUMENTS

| | | | |
|---|---|---|---|
| CN | 114201824 | A | 3/2022 |
| CN | 114492213 | A | 5/2022 |
| WO | 2021112893 | A1 | 6/2021 |
| WO | 2021150929 | A1 | 7/2021 |
| WO | 2021252350 | A1 | 12/2021 |

OTHER PUBLICATIONS

Office Action issued in corresponding U.S. Appl. No. 18/162,592; dated Aug. 8, 2025 (21 pages).

Non-Final Office Action issued in related U.S. Appl. No. 18/162,592 dated Jan. 23, 2025 (22 pages).

E.B. Neitzel and T.K. Kan, "Reconciliation of Measurement Differences Observed from Seismic, Well Logs, and VSP," SEG Technical Programs Expanded Abstracts; 1984; pp. 25-28 (4 pages).

R. G. Pratt and M. S. Sams; "Reconciliation of crosshole seismic velocities with well information in a layered sedimentary environment", Geophyics; vol. 61; No. 2; 1996; pp. 549-560 (12 pages).

R. G. Pratt and R. M. Shipp; "Seismic waveform inversion in the frequency domain, Part 2: Fault delineation in sediments using crosshole data," Geophysics; vol. 64; No. 3; 1999; pp. 902-914 (13 pages).

V. Prieux et al.; "On the footprint of anisotropy on isotropic full waveform inversion: the Valhall case study", Geophysics Journal International; vol. 187; 2011; pp. 1495-1515 (21 pages).

C. Barnes et al.; "Feasibility study for an anisotropic full waveform inversion of cross-well seismic data," Geophysical Prospecting; vol. 56; 2008; pp. 897-906 (10 pages).

D. Grana et al.; "Quantitative log interpretation and uncertainty propagation of petrophysical properties and facies classification from rock-physics modeling and formation evaluation analysis", Geophysics; vol. 77; No. 3; 2012; pp. WA45-WA63 (19 pages).

M. Saneifar et al.; "Rock Classification in the Haynesville Shale-Gas Formation Based on Petrophysical and Elastic Rock Properties Estimated from Well Logs", SPE-166328; Society of Petroleum Engineers; 2013; pp. 1-12 (12 pages).

S.F. Wong et al.; "Crude oil emulsion: A review on formation, classification and stability of water-in-oil emulsions", Journal of Petroleum Science and Engineering; vol. 135; 2015; pp. 498-504 (7 pages).

M. Saneifar et al.; "Rock classification in the Haynesville Shale based on petrophysical and elastic properties estimated from well logs", Intepretation; vol. 3; No. 1; Feb. 2015; pp. SA65-SA75 (11 pages).

A. Gonzalez et al.; "Integrated Multi-Physics Workflow for Automatic Rock Classification and Formation Evaluation Using Multi-Scale Image Analysis and Conventional Well Logs", SPWLA 60th Annual Logging Symposium; Jun. 15-19, 2019; pp. 1-19 (19 pages).

M. Fakir and M. Ferentinou; "A holistic open pit mine slope stability index using artificial neural networks", AfriRock 2017 Rock Mechanics for Africa; Oct. 2017; pp. 331-349 (19 pages).

Y. Zhang et al.; "Automated Classification Analysis of Geological Structures Based on Images Data and Deep Learning Model", Applied Sciences; vol. 8; No. 12; Dec. 4, 2018; pp. 1-16 (16 pages).

Z. Xu et al.; "Integrated lithology identification based on images and elemental data from rocks", Journal of Petroleum Science and Engineering; vol. 205; Apr. 22, 2021; pp. 1-13 (13 pages).

Z. Xu et al.; "Intelligent On-Site Lithology Identification Based on Deep Learning of Rock images and Elemental Data", IEEE Geoscience and Remote Sensing Letters; vol. 19; 2022; pp. 1-5 (5 pages).

E.E. Baraboshkin et al.; "Deep Convolutions for In-Depth Automated Rock Typing", Computers and Geosciences Journal; arXiv: 1909.10227; Sep. 26, 2019; pp. 1-24 (24 pages).

F. Alzubaidi et al.; "Automated Rock Quality Designation Using Convolutional Neural Networks", Rock Mechanics and Rock Engineering; vol. 55; Feb. 26, 2022; pp. 3719-3734 (16 pages).

F. Antonsen et al.; "Net pay Optimization and Improved Reservoir Mapping From Ultra-Deep Look Around LWD-measurements", SPE-171856-MS; Society of Petroleum Engineers; Nov. 2014; pp. 1-15 (15 pages).

D. Omeragic et al.; "Integration of Well Logs and Reservoir Geomodels For Formation Evaluation in High-Angle and Horizontal Wells" SPWLA 52nd Annual Logging Symposium; May 2011; pp. 1-15 (15 pages).

V. Polyakov et al.; "3D Reservoir Characterization Workflow Integrating High Angle and Horizontal Well Log Interpretation with Geological Models", IPTC 16828; International Petroleum Technology Conference; Mar. 2013; pp. 1-8 (8 pages).

G. Massuka Benidiktus et al.; "Integrated Reservoir Analysis and Geomodeling on Shallow Zone of Handil Field, a Key to Identify Un-Swept Area for Future Development of Mature Oil Field", SPE-186299-MS; Society of Petroleum Engineers; Oct. 2017; pp. 1-11 (11 pages).

M. Iversen et al.; "Geosteering using Ultradeep Resistivity on the Grane Field, Norwegian North Sea," Petrophysics; vol. 45; No. 3; 2004; pp. 232-240 (9 pages).

A. V. Timonov et al.; "Automated Geosteering Optimization Using Machine Learning", SPE-207364-MS; Society of Petroleum Engineers; Nov. 2021; pp. 1-13 (13 pages).

* cited by examiner

METHODS AND SYSTEMS FOR PREDICTING CONDITIONS AHEAD OF A DRILL BIT

CROSS-REFERENCE TO RELATED APPLICATIONS

This application is related to co-pending application Ser. No. 18/162,592, titled "Geosteering using improved data conditioning" filed on the same date as the present application and co-pending application Ser. No. 18/162,609, titled "Geosteering using reconciled subsurface physical parameters" filed on the same date as the present application. These co-pending patent applications are hereby incorporated by reference herein in their entirety.

BACKGROUND

Geosteering may enable an optimal placement of a wellbore based on the results of real-time downhole geological and geophysical logging measurements rather than three-dimensional targets in space. For example, geosteering may be used to keep a directional wellbore within a hydrocarbon pay zone, to keep a wellbore in a particular section of a reservoir to minimize gas or water breakthrough and maximize economic production from the well, etc. When drilling a borehole, geosteering provides adjustment of the borehole position on the fly to reach one or more geological targets. The adjustments may be based on various data gathered while drilling.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method for predicting conditions ahead of a drill bit while drilling a well, the method comprising: performing, using a machine learning model, a classification of formation properties ahead of the drill bit, based on data comprising logging-while-drilling (LWD) data obtained while drilling the well.

In general, in one aspect, embodiments relate to a system for predicting conditions ahead of a drill bit while drilling a well, the system comprising: a drilling system for drilling the well, the drilling system comprising the drill bit and a drill bit logging tool; and a control system configured to: perform, using a machine learning model, a classification of formation properties ahead of the drill bit, based on data comprising logging-while-drilling (LWD) data obtained from the drill bit logging tool while drilling the well using the drill bit.

In general, in one aspect, embodiments relate to a non-transitory machine-readable medium comprising a plurality of machine-readable instructions executed by one or more processors, the plurality of machine-readable instructions causing the one or more processors to perform operations comprising: performing, using a machine learning model, a classification of formation properties ahead of a drill bit while drilling a well, based on data comprising logging-while-drilling (LWD) data obtained while drilling the well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
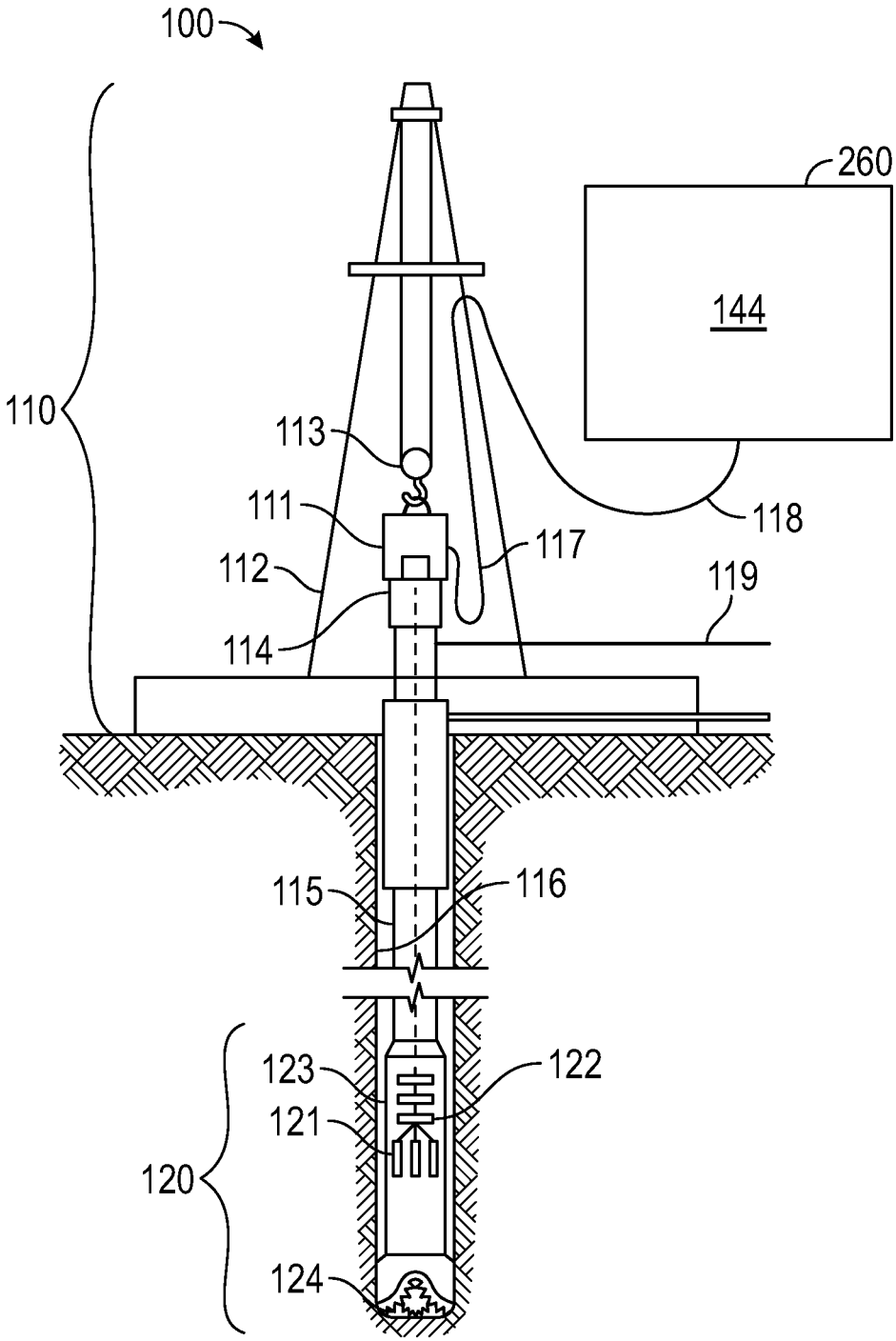
FIG. 1 shows a system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for predicting conditions ahead of a drill bit.

During drilling, real-time data may be acquired from multiple different sources. For example, surface drilling parameters may be obtained from the sensors attached to the drilling framework; logging while drilling (LWD) data may be obtained from the sensors attached to the drill pipe in the wellbore. Additional data may be obtained from other data sources.

Using at least some of these data, embodiments of the disclosure enable a looking ahead of the bit, which may allow determination of formation properties including lithology and saturation patterns ahead of the bit for geosteering purposes. The lithology of a rock unit is a description of its physical characteristics. These physical characteristics may include, but are not limited to, texture, grain size, and composition which may affect porosity, permeability, etc. The saturation may reflect the presence and extent of a fluid phase within the rock unit and may further identify the type of the fluid phase.

The formation properties may be classified based on reconciled looking ahead of the bit data. The looking ahead of the bit data, in one or more embodiments, produces a prediction of the formation properties (such as saturation, boundaries and other impediments) ahead of the bit rather than at the bit. In other words, for a forward-moving a, the prediction is for formation properties that will be relevant in the future, as the drill bit is moving forward. For example, the looking ahead of bit data may reach up to 60-90 feet in vertical wells to 45-75 feet in high angle (horizontal wells).

In one or more embodiments, a deep learning neural network is used for the classification of the lithology and saturation patterns ahead of the bit. The classification may be performed in real-time and may be used for geosteering. The deep learning neural network may be based on restricted Boltzmann machines. A detailed description is subsequently provided.

FIG. 1 shows a drilling system (100) that may include a top drive drilling rig (110) arranged around the setup of a drill bit logging tool (120) in a logging-while-drilling (LWD) configuration. The drilling system (100) may include geosteering functionality, further discussed below. A top drive drilling rig (110) may include a top drive (111) that may be suspended in a derrick (112) by a travelling block (113). In the center of the top drive (111), a drive shaft (114) may be coupled to a top pipe of a drill string (115), for example, by threads. The top drive (111) may rotate the drive shaft (114), so that the drill string (115) and a drill bit logging tool (120) cut the rock at the bottom of a wellbore (116). A power cable (117) supplying electric power to the top drive (111) may be protected inside one or more service loops (118) coupled to a control system (144). As such, drilling mud may be pumped into the wellbore (116) through a mud line (119), the drive shaft (114), and/or the drill string (115).

Figure 4:
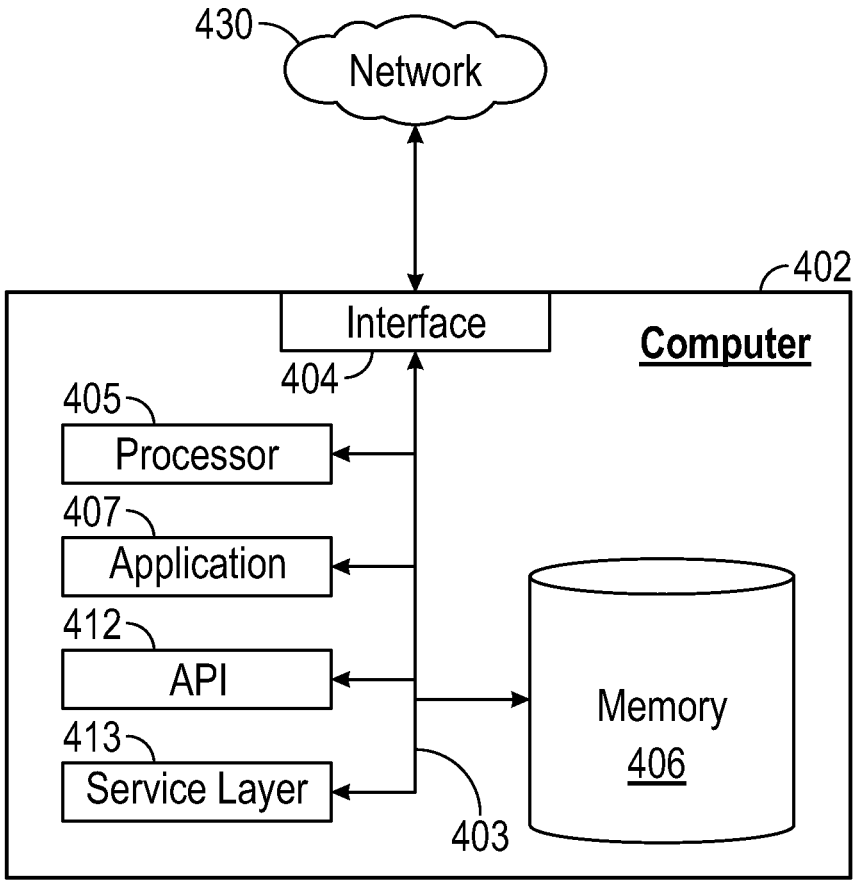
FIG. 4 shows a computer system in accordance with one or more embodiments.

The control system (144) may include one or more programmable logic controllers (PLCs) that include hardware and/or software with functionality to control one or more processes performed by the drilling system (100). Specifically, a programmable logic controller may control valve states, fluid levels, pipe pressures, warning alarms, and/or pressure releases throughout a drilling rig. In particular, a programmable logic controller may be a ruggedized computer system with functionality to withstand vibrations, extreme temperatures, wet conditions, and/or dusty conditions, for example, around a drilling rig. For example, the control system (144) may be coupled to the sensor assembly (123) in order to perform various program functions for up-down steering and left-right steering of the drill bit (124) through the wellbore (116). While one control system is shown in FIG. 1, the drilling system (100) may include multiple control systems for managing various well drilling operations, maintenance operations, well completion operations, and/or well intervention operations. The control system (144) may be based on a computer system as shown in FIG. 4.

The wellbore (116) may include a bored hole that extends from the surface into a target zone of the hydrocarbon-bearing formation, such as the reservoir. An upper end of the wellbore (116), terminating at or near the surface, may be referred to as the "up-hole" end of the wellbore (116), and a lower end of the wellbore, terminating in the hydrocarbon-bearing formation, may be referred to as the "down-hole" end of the wellbore (116). The wellbore (116) may facilitate the circulation of drilling fluids during well drilling operations, the flow of hydrocarbon production ("production") (e.g., oil and gas) from the reservoir to the surface during production operations, the injection of substances (e.g., water) into the hydrocarbon-bearing formation or the reservoir during injection operations, or the communication of monitoring devices (e.g., logging tools) into the hydrocarbon-bearing formation or the reservoir during monitoring operations (e.g., during in situ logging operations).

As further shown in FIG. 1, sensors (121) may be included in a sensor assembly (123), which is positioned adjacent to a drill bit (124) and coupled to the drill string (115). Sensors (121) may also be coupled to a processor assembly (123) that includes a processor, memory, and an analog-to-digital converter (122) for processing sensor measurements. For example, the sensors (121) may include acoustic sensors, such as accelerometers, measurement microphones, contact microphones, and hydrophones. Likewise, the sensors (121) may include other types of sensors, such as transmitters and receivers to measure resistivity (obtained through electromagnetic (EM) measurements and/or sonic measurements), gamma ray detectors, nuclear magnetic resonance (NMR) imaging devices, neutron detectors, gamma ray detectors, etc. The sensors (121) may include hardware and/or software for generating different types of well logs (such as acoustic logs or sonic logs) that may provide well data about a wellbore, including porosity of wellbore sections, gas saturation, bed boundaries in a geologic formation, fractures in the wellbore or completion cement, and many other pieces of information about a formation. If such well data are acquired during well drilling operations (i.e., logging-while-drilling (LWD)), then the information may be used to make adjustments to drilling operations in real-time in a geosteering configuration of the drill bit (124). Such adjustments may include rate of penetration (ROP), weight on bit (WOB), torque, revolutions per minute (RPM), hook load, mud flow rate, D-exponent, mud density/weight, standpipe pressure, mud temperature, drilling direction, and many others drilling parameters.

The signals obtained from the sensors (121) may be processed and analyzed to determine well data, such as lithological and petrophysical properties of the rock formation, including saturation range. These well data may be used in various applications, such as steering a drill bit using geosteering, casing shoe positioning, etc.

Figure 2:
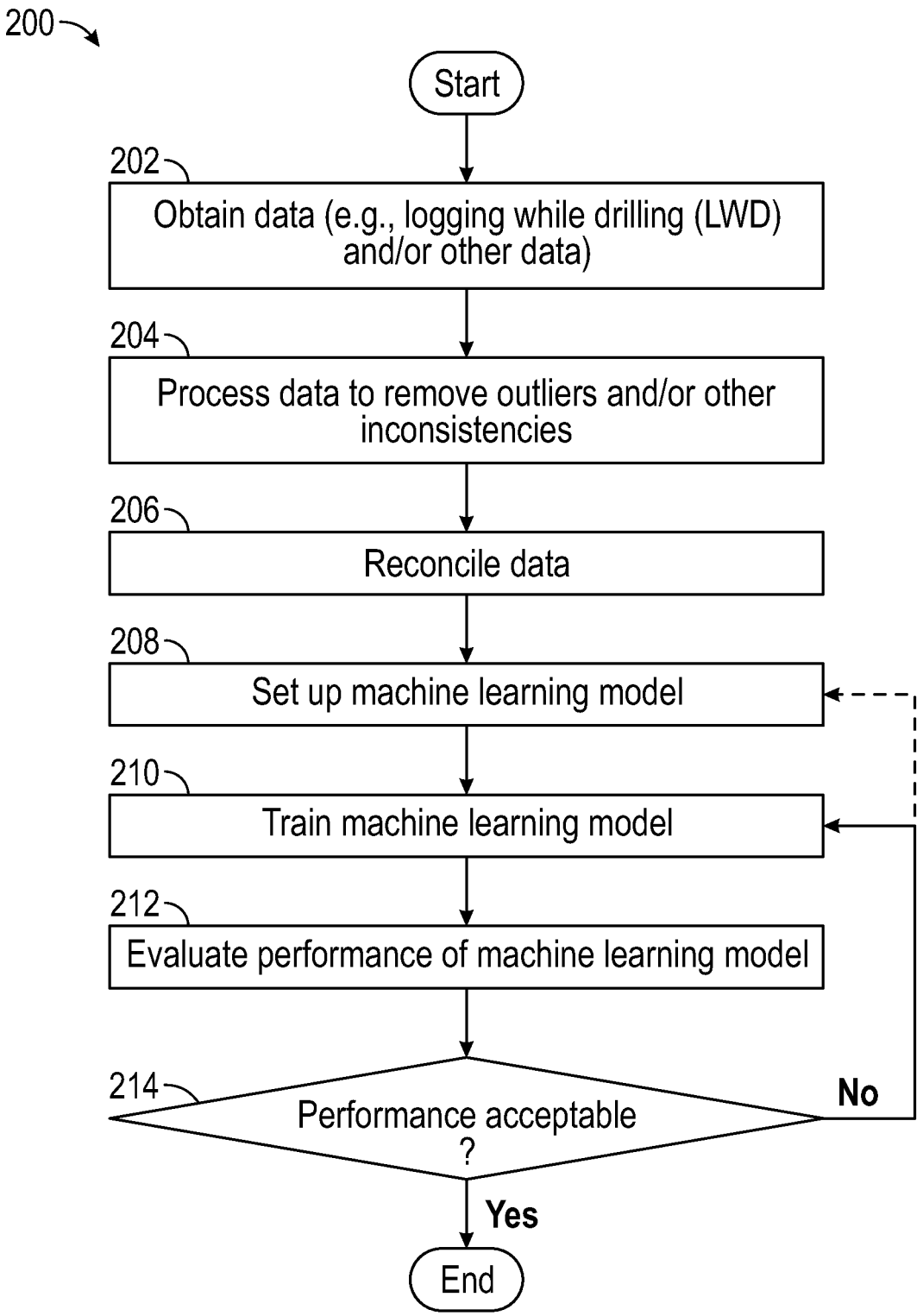
FIG. 2 shows a flowchart of a method for predicting conditions ahead of a drill bit, in accordance with one or more embodiments.
Figure 3:
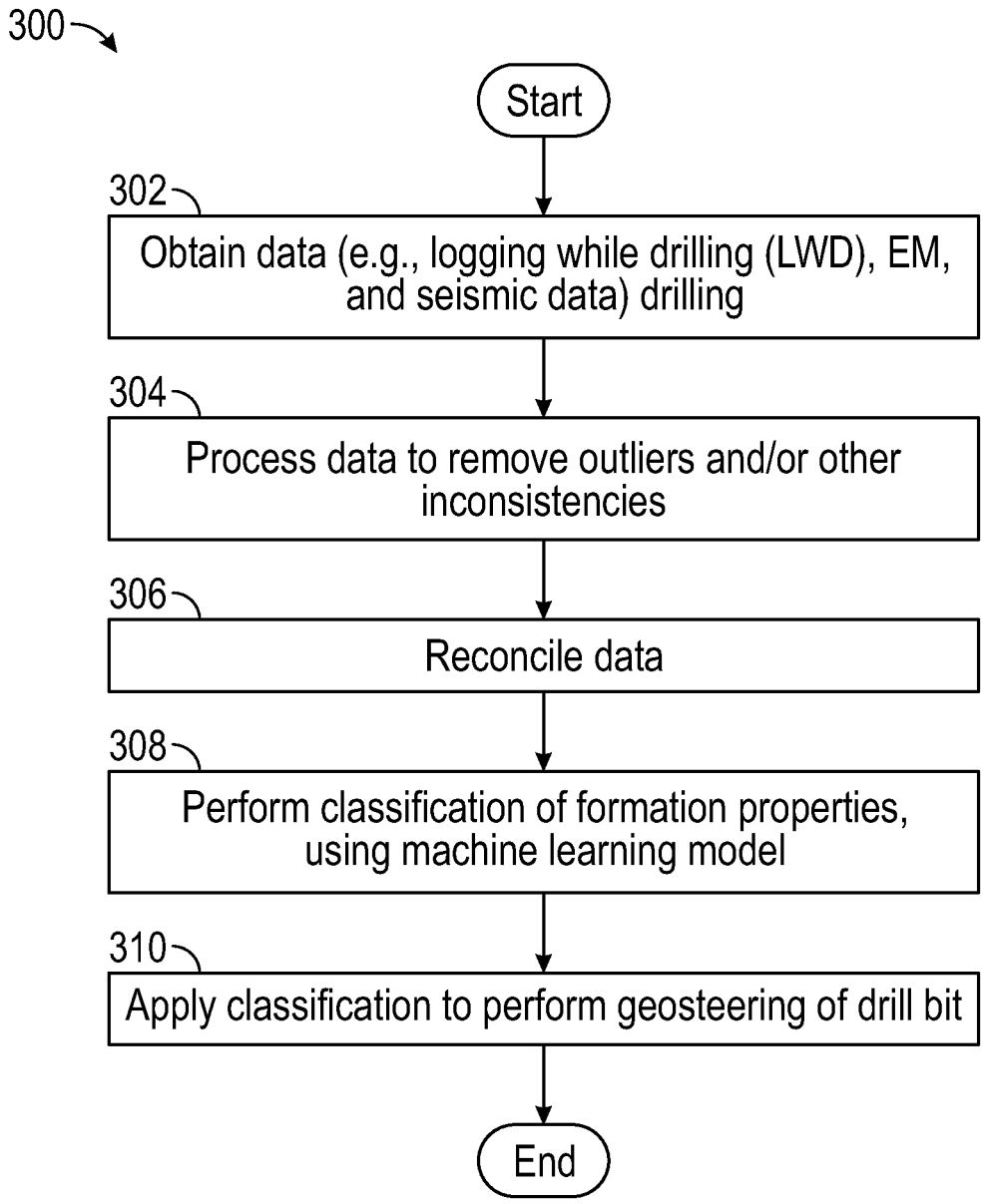
FIG. 3 shows a flowchart of a method for predicting conditions ahead of a drill bit, in accordance with one or more embodiments.

One or more components of the drilling system (100) may form a system for predicting conditions ahead of the drill bit. The system for predicting conditions ahead of the drill bit may include a computing system such as the computing system shown in FIG. 4. The computing system may be the control system (144) or any other computing system. The computing system, in one or more embodiments performs a method for predicting conditions ahead of the drill bit, as shown in FIGS. 2 and 3. The system for predicting conditions ahead of the drill bit may include other components, in addition to the computing system. For example, the system for predicting conditions ahead of the drill bit may include data sources other than the previously described sensors (121).

Keeping with FIG. 1, when completing a well, one or more well completion operations may be performed prior to delivering the well to the party responsible for production or injection. Well completion operations may include casing operations, cementing operations, perforating the well, gravel packing, directional drilling, hydraulic and acid stimulation of a reservoir region, and/or installing a production tree or wellhead assembly at the wellbore (116). Likewise, well operations may include open-hole completions or cased-hole completions. For example, an open-hole completion may refer to a well that is drilled to the top of the hydrocarbon reservoir. Thus, the well is cased at the top of the reservoir, and left open at the bottom of a wellbore. In contrast, cased-hole completions may include running casing into a reservoir region. Cased-hole completions are discussed further below with respect to perforation operations.

In one well operation example, the sides of the wellbore (116) may require support, and thus casing may be inserted into the wellbore (116) to provide such support. After a well has been drilled, casing may ensure that the wellbore (116) does not close in upon itself, while also protecting the well stream from outside incumbents, like water or sand. Likewise, if the formation is firm, casing may include a solid string of steel pipe that is run on the well and will remain that way during the life of the well. In some embodiments, the casing includes a wire screen liner that blocks loose sand from entering the wellbore (116).

In another well operation example, a space between the casing and the untreated sides of the wellbore (116) may be cemented to hold a casing in place. This well operation may include pumping cement slurry into the wellbore (116) to displace existing drilling fluid and fill in this space between the casing and the untreated sides of the wellbore (116). Cement slurry may include a mixture of various additives and cement. After the cement slurry is left to harden, cement may seal the wellbore (116) from non-hydrocarbons that attempt to enter the well stream. In some embodiments, the cement slurry is forced through a lower end of the casing and into an annulus between the casing and a wall of the wellbore (116). More specifically, a cementing plug may be used for pushing the cement slurry from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

Keeping with well operations, some embodiments include perforation operations. More specifically, a perforation operation may include perforating casing and cement at different locations in the wellbore (116) to enable hydrocarbons to enter a well stream from the resulting holes. For example, some perforation operations include using a perforation gun at different reservoir levels to produce holed sections through the casing, cement, and sides of the wellbore (116). Hydrocarbons may then enter the well stream through these holed sections. In some embodiments, perforation operations are performed using discharging jets or shaped explosive charges to penetrate the casing around the wellbore (116).

In another well operation, a filtration system may be installed in the wellbore (116) in order to prevent sand and other debris from entering the well stream. For example, a gravel packing operation may be performed using a gravel-packing slurry of appropriately sized pieces of coarse sand or gravel. As such, the gravel-packing slurry may be pumped into the wellbore (116) between a casing's slotted liner and the sides of the wellbore (116). The slotted liner and the gravel pack may filter sand and other debris that might have otherwise entered the well stream with hydrocarbons.

In some embodiments, well intervention operations may include various operations carried out by one or more service entities for an oil or gas well during its productive life (e.g., fracking operations, CT, flow back, separator, pumping, wellhead and Christmas tree maintenance, slickline, wireline, well maintenance, stimulation, braded line, coiled tubing, snubbing, workover, subsea well intervention, etc.). For example, well intervention activities may be similar to well completion operations, well delivery operations, and/or drilling operations in order to modify the state of a well or well geometry. In some embodiments, well intervention operations provide well diagnostics, and/or manage the production of the well. With respect to service entities, a service entity may be a company or other actor that performs one or more types of oil field services, such as well operations, at a well site. For example, one or more service entities may be responsible for performing a cementing operation in the wellbore (116) prior to delivering the well to a producing entity.

While FIG. 1 shows various configurations of components, other configurations may be used without departing from the scope of the disclosure. For example, various components in FIG. 1 may be combined to create a single component. As another example, the functionality performed by a single component may be performed by two or more components.

FIGS. 2 and 3 show flowcharts in accordance with one or more embodiments. The flowchart of FIG. 2 relates to a method (200) for predicting conditions ahead of a drill bit and includes steps for training a machine learning model. The flowchart of FIG. 3 relates to a method (300) for predicting conditions ahead of a drill bit and includes steps for executing the machine learning model to make the predictions.

The methods (200, 300) provide a classification of formation properties from reconciled looking ahead of the bit data. The methods, in one embodiment, use a deep learning neural network based on restricted Boltzmann machines for the classification of the lithology and saturation patterns for geosteering in real-time.

One or more steps in FIGS. 2 and 3 may be performed by one or more components introduced in FIG. 1, on a computer system, e.g., as shown in FIG. 4. While the various steps in FIGS. 2 and 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Turning to FIG. 2, in Step 202 data are obtained. The data may include logging while drilling (LWD) data. The logs of the LWD may include sonic data, deep azimuthal resistivity data, porosity data, density data, pressure data, and/or temperature data. Any data that may be collected during drilling may be included in the data. The data may further include electromagnetic (EM) data, e.g., in the form of resistivity cubes. The data may also include seismic data, e.g., in the form of acoustic impedance profiles derived from the seismic traces.

Each of these data may be used to characterize the rock or sediment in a borehole. In one or more embodiments, the obtained data are automatically categorized in terms of their data quality. This may be achieved by analyzing the signal to noise ratio, followed by categorizing the data into several categories based on their data quality (e.g., from 1 to 5, where 1 is poor data quality and 5 is best data quality). The data may also be categorized based on the resolution they can attain. The data undergoing this characterization is not limited to LWD data. For example, conventional electromagnetics and seismic data that may be derived from surface EM or seismic surveys, or borehole to surface structures may also be considered in this manner. Some or all these data in combination, including their categorization may be used for the subsequently discussed steps in order to train the machine learning model. The data may be obtained from the well currently being drilled, an offset well within a reservoir formation or other reservoirs.

In Step 204, the data are processed to remove outliers and/or other inconsistencies. Moving windows and/or z-score techniques may be used to perform Step 204. The associated thresholds may be set by a user.

In Step 206, the data are reconciled. The reconciling may involve analyzing and processing the LWD data and/or other data (e.g., EM data, seismic data, etc.) to ensure that the different types of data (e.g., different types of LWD data that are collected) are consistent with each other. The reconciliation of the data utilizes a deep learning approach to check for the consistency of the data in the interpretation. The reconciliation step takes as input different types of logged data (e.g., the different types of available LWD data EM data, seismic data, etc.), and determines whether they lead to similar or deviating estimates using the classification framework discussed below. Types of data that result in deviating estimates are eliminated from further consideration.

In Step 208, a machine learning model is set up.

The machine learning model may be based on any type of machine learning technique. For example, perceptrons, convolutional neural networks, deep neural networks, recurrent neural networks, support vector machines, decision trees, inductive learning models, deductive learning models, reinforcement learning models, etc. may be used. In some embodiments, two or more different types of machine-learning models are integrated into a single machine-learning architecture, e.g., a machine-learning model may include support vector machines and neural networks.

In some embodiments, various types of machine learning algorithms, e.g., backpropagation algorithms, may be used to train the machine learning models. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function"). The error function may be based on various criteria, such as mean squared error function, a similarity function, etc., where the error function may be used as a feedback mechanism for tuning weights in the machine-learning model. In some embodiments, historical data, e.g., production data recorded over time may be augmented to generate synthetic data for training a machine learning model.

With respect to neural networks, for example, a neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights for adjusting the data inputs. These network weights may amplify or reduce the value of a particular data input, thereby assigning an amount of significance to various data inputs for a task being modeled. Through machine learning, a neural network may determine which data inputs should receive greater priority in determining one or more specified outputs of the neural network. Likewise, these weighted data inputs may be summed such that this sum is communicated through a neuron's activation function to other hidden layers within the neural network. As such, the activation function may determine whether and to what extent an output of a neuron progresses to other neurons where the output may be weighted again for use as an input to the next hidden layer.

Turning to recurrent neural networks, a recurrent neural network (RNN) may perform a particular task repeatedly for multiple data elements in an input sequence (e.g., a sequence of maintenance data or inspection data), with the output of the recurrent neural network being dependent on past computations (e.g., failure to perform maintenance or address an unsafe condition may produce one or more hazard incidents). As such, a recurrent neural network may operate with a memory or hidden cell state, which provides information for use by the current cell computation with respect to the current data input. For example, a recurrent neural network may resemble a chain-like structure of RNN cells, where different types of recurrent neural networks may have different types of repeating RNN cells. Likewise, the input sequence may be time-series data, where hidden cell states may have different values at different time steps during a prediction or training operation. For example, where a deep neural network may use different parameters at each hidden layer, a recurrent neural network may have common parameters in an RNN cell, which may be performed across multiple time steps. To train a recurrent neural network, a supervised learning algorithm such as a backpropagation algorithm may also be used. In some embodiments, the backpropagation algorithm is a backpropagation through time (BPTT) algorithm. Likewise, a BPTT algorithm may determine gradients to update various hidden layers and neurons within a recurrent neural network in a similar manner as used to train various deep neural networks. In some embodiments, a recurrent neural network is trained using a reinforcement learning algorithm such as a deep reinforcement learning algorithm. For more information on reinforcement learning algorithms, see the discussion below.

Embodiments are contemplated with different types of RNNs. For example, classic RNNs, long short-term memory (LSTM) networks, a gated recurrent unit (GRU), a stacked LSTM that includes multiple hidden LSTM layers (i.e., each LSTM layer includes multiple RNN cells), recurrent neural networks with attention (i.e., the machine-learning model may focus attention on specific elements in an input sequence), bidirectional recurrent neural networks (e.g., a machine-learning model that may be trained in both time directions simultaneously, with separate hidden layers, such as forward layers and backward layers), as well as multidimensional LSTM networks, graph recurrent neural networks, grid recurrent neural networks, etc., may be used. With regard to LSTM networks, an LSTM cell may include various output lines that carry vectors of information, e.g., from the output of one LSTM cell to the input of another LSTM cell. Thus, an LSTM cell may include multiple hidden layers as well as various pointwise operation units that perform computations such as vector addition.

In some embodiments, one or more ensemble learning methods may be used in connection to the machine-learning models. For example, an ensemble learning method may use multiple types of machine-learning models to obtain better predictive performance than available with a single machine-learning model. In some embodiments, for example, an ensemble architecture may combine multiple base models to produce a single machine-learning model. One example of an ensemble learning method is a BAGGing model (i.e., BAGGing refers to a model that performs Bootstrapping and Aggregation operations) that combines predictions from multiple neural networks to add a bias that reduces variance of a single trained neural network model. Another ensemble learning method includes a stacking method, which may involve fitting many different model types on the same data and using another machine-learning model to combine various predictions.

The selection of the machine learning model in Step 208 may involve selecting the machine learning model with the best performance based on the training of the method (200). The machine learning model with the best performance may be identified through repeated execution of steps of the method (200) using different machine learning models, until the best-performing machine learning model is identified. In one embodiment of the disclosure, a deep learning neural network structure incorporating Restricted Boltzmann Machines (RBM) is used. The RBMs use a forward and backward pass. The RBMs first take the input, which are the reconciled data from the drilling process. The data are translated and encoded in the forward pass. This combines the inputs with the weights, which are then passed over to the hidden layers. The subsequent backward pass then takes the output and reconstructs the input data. The RBMs combine the weights with individual activations. Next, the input is reconstructed from the output. Subsequently, the original input is compared to the reconstruction utilizing the RBMs in order to assess the result's quality.

In one or more embodiments, the architecture of the deep learning neural network is in the form of a supervised network for the classification of the geological parameters. In one embodiment, a deep belief network (DBN) that incorporates RBMs is used. The classification is for the formation properties of the different geological layers being encountered while drilling (e.g., porosity, permeability, rock type structures, saturation, etc.). The DBN may include any number of hidden layers (e.g., 10-30 hidden layers) that are based on RBMs. The final layer may be connected to a logistic regression layer for the classification of the formation properties.

In one or more embodiments, Step 208 involves selecting hyperparameters of the machine learning model, e.g., the complexity of the machine learning model (number of layers, number of neurons, activation functions, etc.). Expert information may be incorporated. In one or more embodiments, expert information is incorporated into the machine learning model in order to optimize the data weighting in the network. Expert information may include, for example, user-provided information such as constraints on the categorization to be performed, as well as adaptation to the input weighting of the parameters (e.g., based on a known level of quality of the input parameters, as previously determined in Step 202).

In Step 210, the machine learning model is trained. The training may involve preparing the previously obtained data for the training. For example, the data may be scaled such that each parameter is in the same range (typically between 0 and 1) to improve the performance of the machine learning model. Further, the data may be split into training, testing and validation sets. Training data may subsequently be used for training the machine learning model. Validation data may be used in order to decide whether enough learning has been achieved and training may be stopped. Testing data may be used to test the performance of the machine learning model after training in order to determine determines how well the machine learning model performs. In one example, 70% of the data may be used as training data and 30% of the data may be used as validation data.

The feature set at the input of the machine learning model may include all types of available input data such as different types of LWD data and may further include any type of other data such as, for example, EM data (e.g., in the form of conductivity reservoir maps), seismic data such as structural geological data information, and drilling-derived data such as the rate of penetration (ROP), weight on bit (WOB), etc. The output data corresponding to the input data used for the training may include classifications of the lithology of the formation (e.g., porosity, permeability, rock type structures, etc.), and/or saturation levels (e.g., in the form of categories from low to high water saturation). For the purpose of training the machine learning model, in the pairing of input data and output data, the output data may be "ahead" of the input data. In other words, for input data associated with a current position of the drill bit, output data associated with a future position of the drill bit may be used. In one embodiment, the various types of input data for the LWD, seismic, and/or EM data are weighted according to their data quality as previously determined in Step 202. Poorly categorized data quality types are weighted less as compared to well categorized data quality types.

The training of the DBN may include a pre-training using a greedy learning algorithm, followed by several steps of Gibbs sampling are utilized for the top hidden layers. Ancestral sampling may be utilized for the rest of the layers, and finally backpropagation may be utilized for the classification task.

In Step 212, the performance of the machine learning model is evaluated. The evaluation may be performed by applying the trained machine learning model to a volume of test data. The resulting classifications of formation properties such as lithology, saturation may be compared to known classifications (e.g., previously performed by an expert, or otherwise obtained) in the test data. In one or more embodiments, evaluating the performance of the machine learning model further includes evaluating the feature set of the machine learning model. Each feature in the feature set may be analyzed on its impact on the estimate produced by the machine learning model. The impact may be assessed, for example, using Shapley values. Less relevant features may be eliminated from the feature set. Accordingly, one or more parameters may be dropped from the input data, as the training is being performed.

In Step 214, based on the evaluation performed in Step 212, a test is performed to determine the performance of the trained machine learning model. The validation data may be used for the test. If a certain accuracy, e.g., at least 80%, 85%, or any other desired accuracy is achieved, the method may terminate the training. Alternatively, if the accuracy is considered insufficient, the method may proceed by repeating either Step 208 with a different machine learning model or a different parameterization of the machine learning model, or by repeating Step 210 using different training data.

Turning to FIG. 3, the execution of the method (300) for predicting conditions ahead of a drill bit begins with the obtaining of data, in Step 302. The data may include logging while drilling (LWD) data, collected in real-time as the drilling is progressing. Additional details regarding Step 302 may be found in the description of Step 202 of FIG. 2.

In Step 304, the data are processed to remove outliers and/or other inconsistencies. Step 304 may be performed analogous to Step 204 of FIG. 2.

In Step 306, the LWD data are reconciled. The reconciliation may be performed analogous to the reconciliation performed in Step 206 of FIG. 2. In other words, types of data that, in Step 206, were found to result in deviating estimates are eliminated from further consideration.

In Step 308, a classification of formation properties is performed (e.g., based on lithology and/or saturation), using the machine learning model after training using the method (200). In one or more embodiments, the classification is ahead-of-the-bit, and may be obtained in real-time, while drilling. The output may further include an uncertainty associated with the classification. The uncertainty may be assessed based on a change in the classification result due to randomly perturbed input data. The degree of uncertainty for each of the classifications is linked to the data quality as well as perceived degree of uncertainty.

In Step 310, the classification of Step 308 may be used in an application. One such application is geosteering the drill bit in an LWD scenario. Adjustments of the rate of penetration (ROP), weight on bit (WOB), torque, revolutions per minute (RPM), hook load, mud flow rate, D-exponent, mud density/weight, standpipe pressure, mud temperature, drilling direction, and many others drilling parameters may be made. The adjustments may be made in an automated manner. However, when uncertainty is high, a geosteering decision maker may ultimately decide on the geosteering parameters.

While geosteering is described as an application of the classification, the classification may be used for other applications without departing from the disclosure.

Embodiments of the disclosure have one or more of the following benefits. Embodiments of the disclosure provide methods to automatically provide a classification of formation properties in a look-ahead-of-the-bit manner. The methods may automatically process LWD data in real-time. The methods may further automatically process EM and seismic data generated from the drill bit. The methods may automatically remove outliers and/or other inconsistencies. The method may further set up a deep neural network for the classification of the reservoir formation properties and to assess uncertainty of the obtained classifications of formation properties.

Embodiments may be implemented on a computer system. FIG. 4 is a block diagram of a computer system (402) used to provide computational functionalities associated with described algorithms, methods, functions, processes, flows, and procedures as described in the instant disclosure, according to an implementation. The illustrated computer (402) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or other suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404 includes logic encoded in software or hardware (or a combination of software and hardware) and operable to communicate with the network (430). More specifically, the interface (404) may include software supporting one or more communication protocols associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing computer (402), each computer (402) communicating over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

In some embodiments, the computer (402) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (Saas), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for predicting conditions ahead of a drill bit while drilling a well, the method comprising:

performing, using a machine learning model, a classification of formation properties ahead of the drill bit, based on data comprising logging-while-drilling (LWD) data obtained while drilling the well;

applying the classification of the formation properties to perform a geosteering of the drill bit;

further comprising, prior to performing the classification;

training the machine learning model;

prior to training the machine learning model;

weighting, in training data used for the training, different types of data based on quality;

wherein the quality is assessed using a signal-to-noise ratio.

2. The method of claim 1, wherein the classification is performed in real-time, while drilling the well.

3. The method of claim 1, wherein the classification of the formation properties comprises a classification of at least one selected from a group consisting of lithology and saturation.

4. The method of claim 1, wherein the classification of the formation properties comprises a quantification of an uncertainty of the classification.

5. The method of claim 1, wherein the data further comprise at least one selected from a group consisting of electromagnetic data and seismic data.

6. The method of claim 1, wherein the LWD data comprise at least one selected from a group consisting of sonic data, deep azimuthal resistivity data, porosity data, density data, pressure data, and temperature data.

7. The method of claim 1, further comprising, prior to performing the classification:

reconciling the data to eliminate inconsistencies between different types of data in the data.

8. The method of claim 1, further comprising, prior to performing the classification:

removing outliers from the data.

9. The method of claim 1, wherein the machine learning model is a deep belief network based on Restricted Boltzmann Machines.

10. The method of claim 1, wherein training data used for the training originates from one selected from a group consisting of an offset well and the well.

11. The method of claim 1, further comprising after training the machine learning model:

evaluating the machine learning model; and retraining the machine learning model when performance is considered insufficient, based on the evaluation of the machine learning model.

12. A system for predicting conditions ahead of a drill bit while drilling a well, the system comprising:

a drilling system for drilling the well, the drilling system comprising the drill bit and a drill bit logging tool; and a control system configured to:

perform, using a machine learning model, a classification of formation properties ahead of the drill bit, based on data comprising logging-while-drilling (LWD) data obtained from the drill bit logging tool while drilling the well using the drill bit;

applying the classification of the formation properties to perform a geosteering of the drill bit;

further comprising, prior to performing the classification:

training the machine learning model;

prior to training the machine learning model:

weighting, in training data used for the training, different types of data based on quality;

wherein the quality is assessed using a signal-to-noise ratio.

13. The system of claim 12, wherein the classification is performed in real-time, while drilling the well.

14. A non-transitory machine-readable medium comprising a plurality of machine-readable instructions executed by one or more processors, the plurality of machine-readable instructions causing the one or more processors to perform operations comprising:

performing, using a machine learning model, a classification of formation properties ahead of a drill bit while drilling a well, based on data comprising logging-while-drilling (LWD) data obtained while drilling the well;

applying the classification of the formation properties to perform a geosteering of the drill bit;

further comprising, prior to performing the classification: training the machine learning model;

prior to training the machine learning model:

weighting, in training data used for the training, different types of data based on quality;

wherein the quality is assessed using a signal-to-noise ratio.

* * * * *